US011142896B2

(12) United States Patent
Brady et al.

(10) Patent No.: US 11,142,896 B2
(45) Date of Patent: Oct. 12, 2021

(54) FLOW TURBULENCE REDUCER

(71) Applicant: Prier Products, Inc., Grandview, MO (US)

(72) Inventors: Scott P. Brady, Lake Winnebago, MO (US); William C. Seitter, Overland Park, KS (US); Joseph E. Poskin, Prairie Village, KS (US)

(73) Assignee: Prier Products, Inc., Grandview, MO (US)

( * ) Notice: Subject to any disclaimer, the term of this patent is extended or adjusted under 35 U.S.C. 154(b) by 116 days.

(21) Appl. No.: 16/384,496

(22) Filed: Apr. 15, 2019

(65) Prior Publication Data

US 2020/0325664 A1 Oct. 15, 2020

(51) Int. Cl.
*E03C 1/10* (2006.01)
*E03C 1/08* (2006.01)

(52) U.S. Cl.
CPC . *E03C 1/10* (2013.01); *E03C 1/08* (2013.01)

(58) Field of Classification Search
CPC ..... Y10T 137/3149; Y10T 137/3185; Y10T 137/3258; Y10T 137/3294; Y10T 137/7897; E03C 1/10; E03C 1/08; F16K 47/14
See application file for complete search history.

(56) References Cited

U.S. PATENT DOCUMENTS 3,424,189 A * 1/1969 Woodford ..... E03B 9/025 137/218
3,797,511 A * 3/1974 Selby ..... F16K 17/19 137/71
3,952,770 A * 4/1976 Botnick ..... E03B 9/025 137/360
4,541,448 A * 9/1985 Kolze ..... F16K 17/38 126/588
4,712,574 A * 12/1987 Perrott ..... F16K 15/148 137/217
4,821,762 A * 4/1989 Breneman ..... E03B 7/10 137/218
5,518,020 A * 5/1996 Nowicki ..... A47L 15/4427 137/216
5,740,831 A * 4/1998 DeNardo ..... E03B 7/10 137/218
9,010,371 B2 * 4/2015 Folk ..... F16K 47/08 137/625.33
2006/0096650 A1 * 5/2006 Sawchuk ..... G01F 1/662 138/39
2010/0229961 A1 * 9/2010 Ball ..... E03B 7/10 137/299
2013/0247995 A1 * 9/2013 Ehrlich ..... F16K 47/14 137/1
2019/0316707 A1 * 10/2019 Helfer ..... F16K 1/22

* cited by examiner

*Primary Examiner* — Jessica Cahill
(74) *Attorney, Agent, or Firm* — Erickson Kernell IP, LLC

(57) ABSTRACT

A turbulence reducer integrated in a vacuum breaker of a hydrant to reduce leakage during use of the hydrant by reducing turbulence acting on the vacuum breaker poppet.

19 Claims, 3 Drawing Sheets

FLOW TURBULENCE REDUCER

FIELD

The present invention generally relates to vacuum breakers in water hydrants, and more particularly, to a turbulence reducer in the flow of water through a water hydrant to reduce leaking from the vacuum breaker.

BACKGROUND

Hydrants, also known as sillcocks, hose bibbs, spigots, freezeless hydrants, faucets and water fixtures are known in the art. Hydrants are used to supply water to the outside of a building. A problem with prior art hydrants and sillcocks is the vacuum breaker often leaks during normal use of the hydrant constantly discharging water through the vacuum breaker onto the ground, floor or other surface below the hydrant resulting in a waste of water, an unsafe wet surface, damage to the surface, or simply an irritant for the user.

SUMMARY

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter.

The present invention is directed to a turbulence reducer integrated into a vacuum breaker of a hydrant, which reduces leakage during use of the hydrant by reducing turbulence acting on the vacuum breaker poppet.

Other advantages of the present invention will become apparent from the following description taken in connection with the accompanying drawings, wherein is set forth by way of illustration and example an embodiment of the present invention.

DETAILED DESCRIPTION

Figure 1:
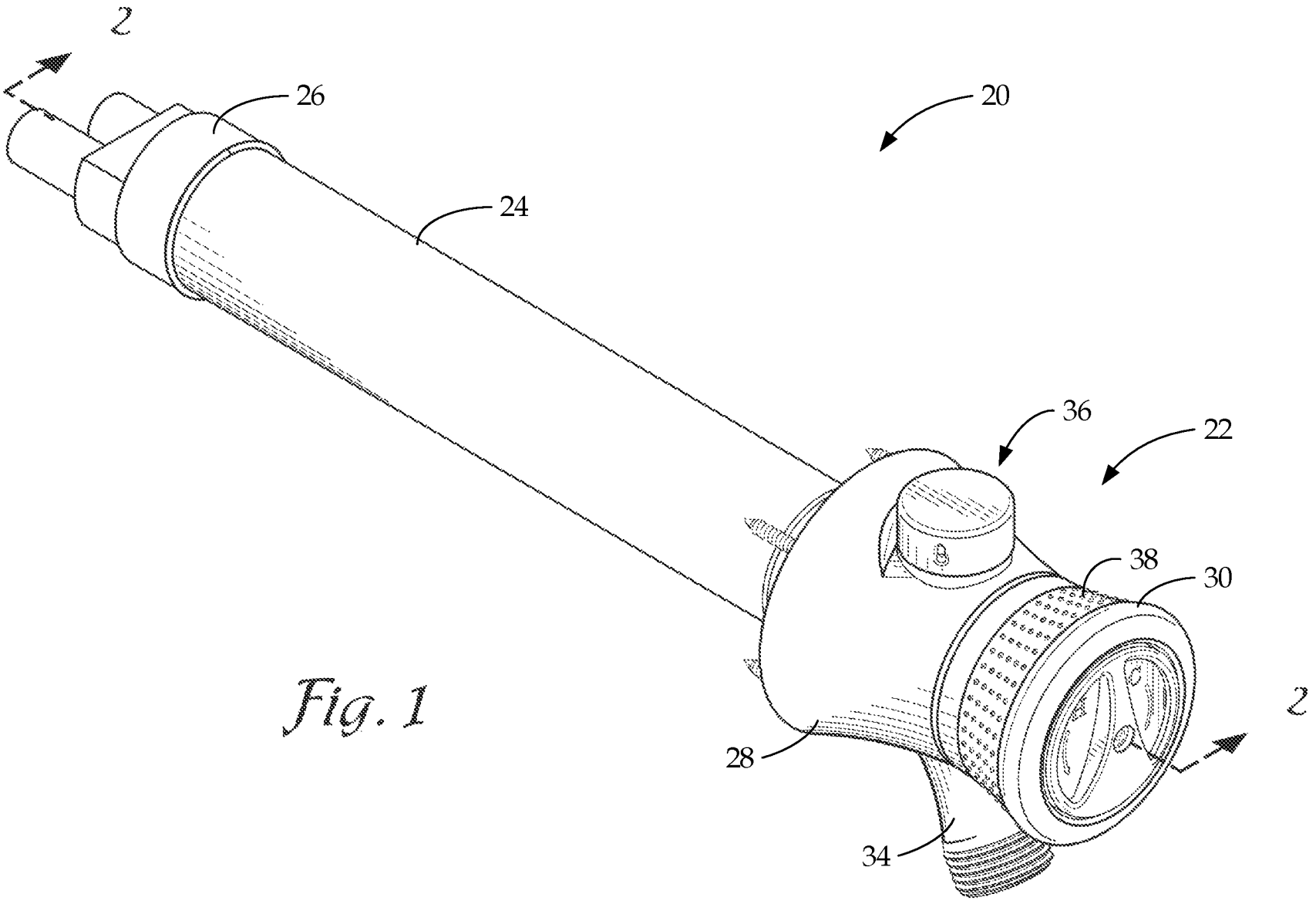
FIG. 1 is a perspective view of a mixing hydrant of the present invention.
Figure 2:
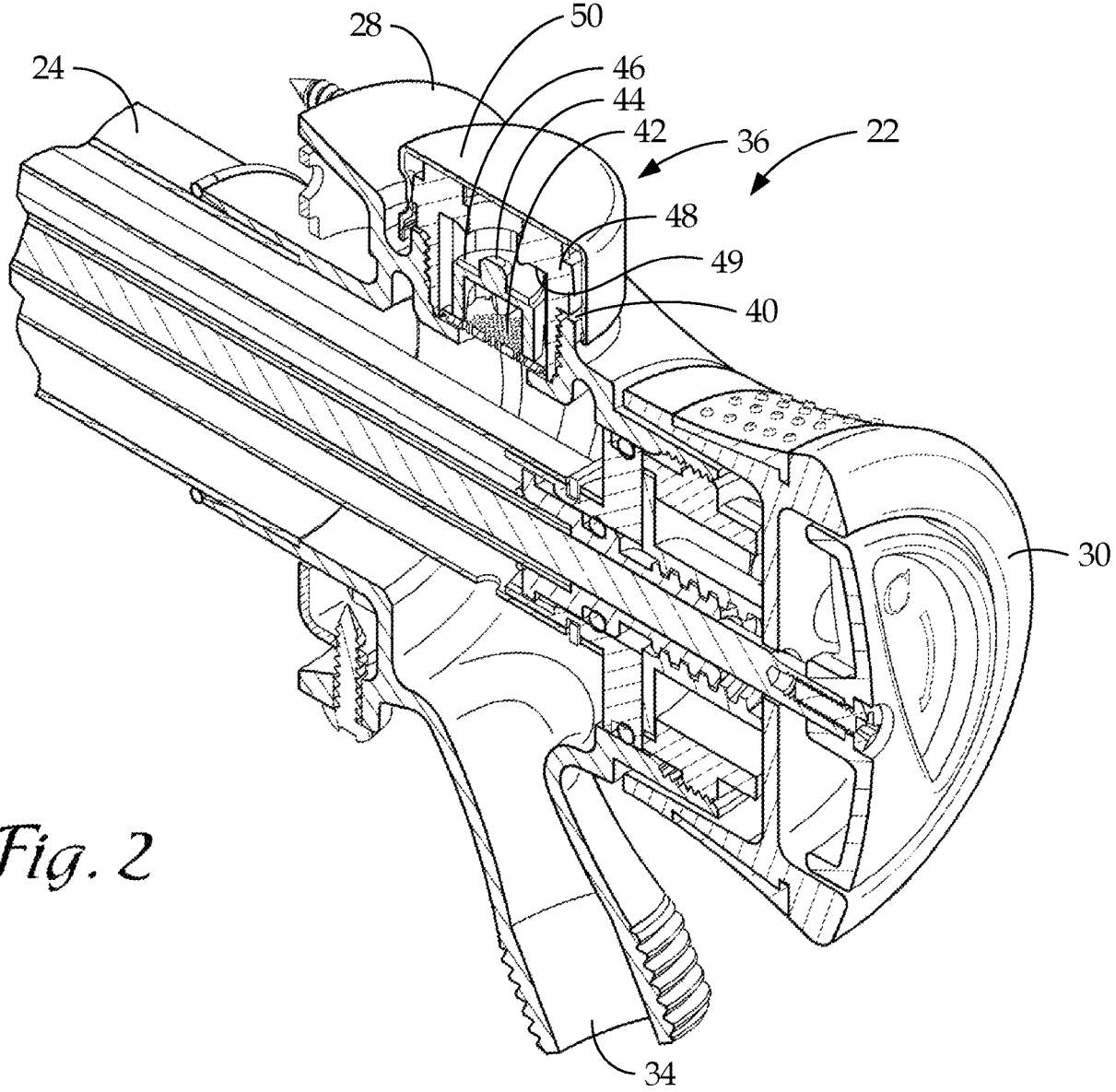
FIG. 2 is an enlarged partial sectional perspective view of the mixing hydrant of FIG. 1 along line 2-2.
Figure 3:
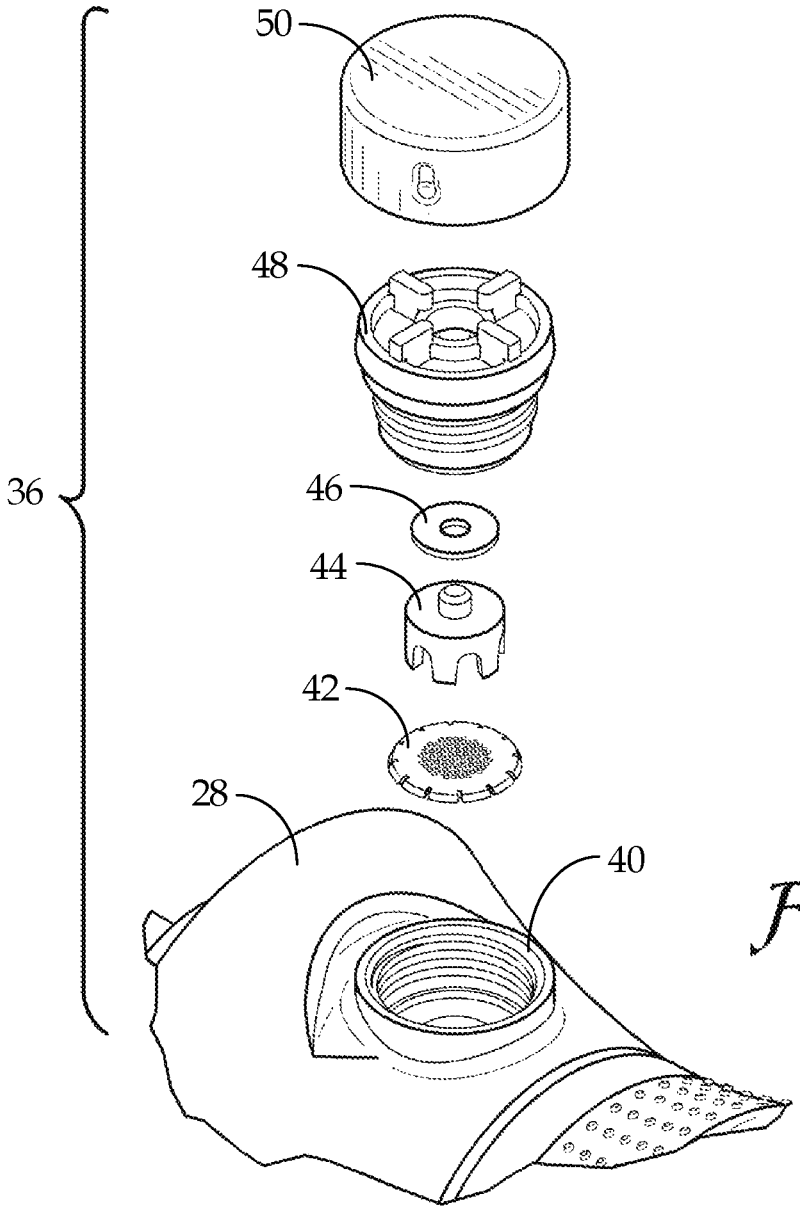
FIG. 3 is an enlarged partial perspective exploded view of the vacuum breaker of the mixing valve of FIG. 1.

Various embodiments of the present invention are disclosed herein, it is to be understood that the disclosed embodiments are merely exemplary of the invention, which may be embodied in various forms. Thus, any specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology used in the following description is for convenience in reference only and is not limiting. For example, the words "forwardly," "rearwardly," "upwardly," "downwardly," "upper," or "lower," for example, all refer to a position or relationship of the item to which the reference is made. The words "inwardly" and "outwardly" refer to directions toward and away from, respectively, the geometric center of the embodiment being designated and parts thereof. The terminology used herein may include the words specifically mentioned, derivatives thereof and words of a similar import. It is further understood that terminology such as the aforementioned directional phrases may be used to describe exemplary embodiments of the mixing hydrant as shown in the figures herein.

Referring to the figures, hydrant is generally indicated by reference numeral 20. Hydrant 20 includes a head 22, a tubular valve body 24, and an inlet connection 26. The head 22 includes a body 28, a flow control knob 30, a spout 34 and a vacuum breaker assembly 36.

A vacuum breaker assembly 36 is secured within a threaded aperture 40 in the upper surface of the body 28 of the head 22. The vacuum breaker assembly 36 includes a turbulence reducer 42, which may be a screen or perforated disk for example, as shown, a vacuum breaker poppet valve 44, a vacuum breaker washer 46, a threaded vacuum breaker poppet valve body 48 having a seat 49, and a vacuum breaker cap 50. The vacuum breaker assembly 36 prevents water from being back-siphoned into the potable water system. This prevents contamination of the water system should the water system's pressure drop and create a back-siphonage condition.

A problem with prior art vacuum breaker assemblies is when the water is on and flowing out of the spout 34, these prior art vacuum breaker assemblies tend to leak. This leakage may be as insignificant as an annoying drip or steady trickle, or more significant causing water damage to the surface below the hydrant. When water is flowing through any hydrant and out the spout, the water flow is turbulent. This turbulence causes the vacuum breaker poppet valve in prior art hydrants to vibrate or chatter and unseat from the vacuum breaker body allowing water to escape from the vacuum breaker assembly.

The vacuum breaker assembly 36 of the present invention eliminates this problem providing a near leak-free design. When water is flowing through the tubular body 24 and out the spout 34, the turbulence is reduced or eliminated from affecting the vacuum breaker poppet valve 44 by the turbulence reducer 42. The turbulence reducer 42 reduces or eliminates the turbulent water flow into the vacuum breaker assembly 36 so that a constant pressure is applied to the vacuum breaker poppet valve 44 and it seals with the vacuum breaker washer 46 against the seat 49 of the vacuum breaker poppet valve body 48 to eliminate or reduce water leakage. The turbulence reducer 42 does not affect the performance of the vacuum breaker assembly 36 with respect to back siphonage.

While certain forms and embodiments of the vehicle carton and method for forming the same have been illustrated and described herein, the present invention is not to be limited to the specific forms or arrangement of parts described and shown, and that the various features described may be combined in ways other than those specifically described without departing from the scope of the present invention.

Having thus described the invention, what is claimed as new and desired to be secured by Letters Patent is as follows:

1. In combination with a water fixture, a flow turbulence reducer assembly comprising:

a vacuum breaker valve body;

a vacuum breaker poppet valve received in said vacuum breaker valve body; and a turbulence reducer having an annular circumference;

said vacuum breaker valve body and said vacuum breaker poppet valve mounted in an aperture in the water fixture;

said turbulence reducer mounted across the aperture between the aperture and said vacuum breaker poppet valve;

said vacuum poppet valve contacting said annular circumference of said turbulence reducer;

whereas said turbulence reducer diminishes the turbulence of water entering the water fixture aperture thereby reducing the leakage of water from the vacuum breaker assembly.

2. The combination of claim 1 further comprising a washer between said vacuum breaker valve body and said vacuum breaker poppet valve to seal said vacuum breaker poppet valve to said vacuum breaker valve body.

3. The combination of claim 1 wherein the aperture is threaded and said vacuum breaker valve body is threaded and received in the threaded aperture.

4. The combination of claim 1 wherein said turbulence reducer is a perforated disk.

5. The combination of claim 1 wherein said turbulence reducer is a screen.

6. The combination of claim 1 wherein said turbulence reducer filters debris from the water passing through the aperture.

7. The combination of claim 1 further comprising a cap secured to and covering said vacuum breaker valve body within the aperture.

8. In combination with a water fixture, a vacuum breaker assembly comprising:

a vacuum breaker valve body having a seat;

a vacuum breaker poppet valve received in said vacuum breaker valve body, and a turbulence reducer having an annular circumference;

said vacuum breaker valve body and said vacuum breaker poppet valve mounted in an aperture in the water fixture;

said turbulence reducer mounted across the aperture between the aperture and said vacuum breaker poppet valve;

said vacuum poppet valve contacting said annular circumference of said turbulence reducer;

whereas said turbulence reducer diminishes the turbulence of water passing through the water fixture and entering the vacuum breaker assembly through the aperture;

whereas said vacuum breaker poppet valve is sealed against said seat by a constant pressure of the water passing through the aperture;

whereby reducing the leakage of water from the vacuum breaker assembly.

9. The combination of claim 8 further comprising a washer between said vacuum breaker valve body and said vacuum breaker poppet valve to seal said vacuum breaker poppet valve to said seat of said vacuum breaker valve body.

10. The combination of claim 8 wherein the aperture is threaded and said vacuum breaker valve body is threaded and received in the threaded aperture.

11. The combination of claim 8 wherein said turbulence reducer is a perforated disk.

12. The combination of claim 8 wherein said turbulence reducer is a screen.

13. The combination of claim 8 wherein said turbulence reducer filters debris from the water passing through the aperture.

14. The combination of claim 8 further comprising a cap secured to and covering said vacuum breaker valve body within the aperture.

15. In combination with a water fixture, a vacuum breaker assembly comprising:

a vacuum breaker valve body having a seat;

a vacuum breaker poppet valve received in said vacuum breaker valve body;

a washer for sealing said vacuum breaker poppet valve against said seat;

a turbulence reducer having a perforated surface and an annular circumference; and a cap;

said vacuum breaker valve body, washer and said vacuum breaker poppet valve mounted in an aperture in the water fixture;

said turbulence reducer mounted across the aperture between the aperture and said vacuum breaker poppet valve;

said vacuum poppet valve contacting said annular circumference of said turbulence reducer;

said cap secured to and covering said vacuum breaker valve body within the aperture;

whereas said turbulence reducer diminishes the turbulence of water passing through the water fixture and entering the vacuum breaker assembly through the aperture;

whereas said washer and said vacuum breaker poppet valve is sealed against said seat by a constant pressure of the water passing through the aperture;

whereby reducing the leakage of water from the vacuum breaker assembly.

16. The combination of claim 15 wherein the aperture is threaded and said vacuum breaker valve body is threaded and received in the threaded aperture.

17. The combination of claim 15 wherein said turbulence reducer is a screen.

18. The combination of claim 15 wherein said turbulence reducer is a disk.

19. The combination of claim 15 wherein said turbulence reducer prevents debris from entering the vacuum breaker valve body through the aperture.

* * * * *